US005725116A

United States Patent [19]

Takai

[11] Patent Number: 5,725,116

[45] Date of Patent: Mar. 10, 1998

[54] CONTAINER CAP HAVING MEANS FOR EVIDENCING CRAFTY UNCAPPING OR SAFE SEALING

[75] Inventor: Kazuo Takai, Hachioji, Japan

[73] Assignee: Cosmo Precision Co., Ltd., Hachioji, Japan

[21] Appl. No.: 796,601

[22] Filed: Feb. 7, 1997

Related U.S. Application Data

[63] Continuation of Ser. No. 544,323, Oct. 17, 1995, abandoned.

[30] Foreign Application Priority Data

Oct. 19, 1994 [JP] Japan ..... 6-280018

[51] Int. Cl.[6] ..... B65D 41/34

[52] U.S. Cl. ..... 215/252; 215/258

[58] Field of Search ..... 215/252, 256, 215/258, 901, 44, 250

[56] References Cited

U.S. PATENT DOCUMENTS

| | | | |
|---|---|---|---|
| 4,241,841 | 12/1980 | Boller | 215/252 |
| 4,432,461 | 2/1984 | Mumford et al. | 215/252 |
| 4,436,212 | 3/1984 | Alejandro Llera | 215/258 X |
| 4,801,030 | 1/1989 | Barriac | 215/252 |
| 5,190,178 | 3/1993 | Luch | 215/256 |

FOREIGN PATENT DOCUMENTS

| | | | |
|---|---|---|---|
| 3727887 | 3/1989 | Germany | 215/252 |
| 53-11180 | 3/1978 | Japan . | |
| 57-28767 | 2/1982 | Japan . | |
| 62-16351 | 1/1987 | Japan . | |
| 1438648 | 6/1976 | United Kingdom | 215/252 |

*Primary Examiner*—Allan N. Shoap
*Assistant Examiner*—Nathan Newhouse
*Attorney, Agent, or Firm*—Christensen O'Connor Johnson & Kindness PLLC

[57] ABSTRACT

A screw cap comprises a main cap portion 1 having screw threads on its inner circumferential surface and a number of splines 6 axially extending on its outer circumferential surface, and a ring portion 11 having a projection 12 on its inner circumferential surface and a number of splines 13 extending on its outer circumferential surface and continuous from the splines 6 of the main cap portion. The ring portion 11 is spaced apart from and connected integrally with the lateral wall of the main cap body by fragile connector strips 15 which are partial extensions of the splines 6 or 13 lying over the distance A between the main cap body 1 and the ring portion 11. Thus the cap has a totally uniform, continuous appearance suitable for containers of products which should desirably look high-graded or uncontaminated.

7 Claims, 1 Drawing Sheet

CONTAINER CAP HAVING MEANS FOR EVIDENCING CRAFTY UNCAPPING OR SAFE SEALING

This application is a continuation of Ser. No. 08/544,323 filed Oct. 17, 1995, now abandoned.

BACKGROUND OF THE INVENTION

1. Field of the Invention

This invention relates to a plastic-resin screw cap having a ring portion continuous from a main cap portion via fragile connector strips and getting into unremovable engagement with a neck of a container once the screw cap is applied to the mouth of the container, such that crafty uncapping or safe sealing of the container is evident from the outer appearance of the screw cap, namely, whether the ring portion is held integral with or has been torn off from the main cap portion.

2. Description of the Related Art

There are known various container caps configured to seal a container aperture by thread engagement therewith and having means for evidencing that the container has been uncapped or has been kept sealed, in order to prevent pilferage of the content or introduction of foreign matters into the content before the product is finally delivered to a consumer after the container is sealed by a manufacturer.

Such screw caps for this purpose, in general, have a ring portion which is continuous from the cylindrical wall of a main cap portion of the screw cap via connector strips and can engage with a lower surface of a ridge formed around the neck of a container, as disclosed by Japanese Utility-Model Publication No. 53-11180 (1978), Japanese Patent Laid-Open No. 57-28767 (1982), Japanese Patent Laid-Open No. 62-16351 (1987), and so forth. When a screw cap sealing a container is rotated to open it, the main cap portion moves in the axial direction toward the uncapping direction (withdrawal direction from the container) as it is rotated. On the other hand, the ring is held in engagement with the container ridge. Therefore, the connector strips are cut due to opposite pulling forces from the main cap portion and the ring portion, and the ring portion is separated from the main cap portion. Once the connector strips are cut, they never become integral with either the main cap portion or the ring portion even after the main cap portion is once again applied onto the container aperture. It is therefore apparent from the outer appearance of the screw cap that the container has ever been uncapped.

Conventional caps of this type have been designed only from the viewpoint of their function, namely, prevention of crafty uncapping, and therefore not suitable for use to containers of products for which the impression of high grade or cleanness is an important factor.

For example, in screw caps of one type as disclosed by the Publication No. 53-11180 (1978), the ring portion is brought into tight engagement with the lower surface of the container ridge by thermal contraction. Therefore, these caps exhibit an ugly appearance with shrinkage marks or irregular waves on the surface of the ring portion. In screw caps of another type as disclosed by the Publication No. 57-28767 (1982), the ring portion expands its diameter when moving across the container ridge during thread-fitting of the screw cap onto the container aperture, and thereafter engages with the lower surface of the container ridge. These caps have a look of disunity or discontinuity in their entire outer appearance, in particular, between the main cap portion and the ring portion. That is, the main cap portion and the ring portion look like separate members at a glance, which may damage a consumer's favorable appreciation onto the product.

OBJECT OF THE INVENTION

It is therefore an object of the present invention to provide a container cap with means for evidencing crafty uncapping of the container, having a ring portion whose appearance is uniform with and continuous from the main cap portion of the cap, and therefore suitable for use with containers for products for which the impression of high grade and cleanness is important.

SUMMARY OF THE INVENTION

According to the invention, there is provided a screw cap comprising:

a main cap portion including a cylindrical lateral wall having an inner surface and an outer surface, the cylindrical lateral wall having screw threads formed on the inner surface and a number of splines axially extending on the outer surface; and a ring portion having an inner surface and an outer surface, the ring portion having a projection formed on the inner surface and a number of splines extending on the outer surface and continuous from the splines of the main cap body, the ring portion being spaced apart from and connected integrally with the cylindrical lateral wall of the main cap portion by connector strips which are partial extensions of the splines lying between the main cap portion and the ring portion.

The ring portion preferably has the same outer diameter and thickness as those of the cylindrical lateral wall of the main cap portion, and the inner step of the ring portion preferably extends over the entire circumference.

When the main cap portion is thread-fitted onto the container aperture, the ring portion is conveyed forward while rotating together and resiliently increasing its inner diameter when passing over the container ridge. When the main cap portion gets into full thread engagement with the container aperture, the inner step of the ring portion engages with the lower surface of the container ridge. Since a number of splines are formed on the main cap portion and the ring portion to continuously extend over the full axial length thereof, the main cap portion and the ring portion exhibit a uniform, continuous and unitary appearance.

When the cap is rotated to uncap the container, the main cap portion is conveyed in the uncapping (withdrawal) direction, but the ring portion is left in engagement with the container ridge, although it can rotate there. Therefore, opposite pulling forces are applied to the connector strips from the main cap portion and the ring portion and snap the connector strips into two parts, one at the side of the main cap portion and the other at the side of the ring portion. Thus the ring portion is irrevocably separated from the main cap portion.

The foregoing and other objects, features and advantages of the invention will become more apparent in the light of the following description of preferred embodiments thereof, as illustrated in the accompanying drawings.

DETAILED DESCRIPTION OF THE PREFERRED EMBODIMENT

Figure 1:
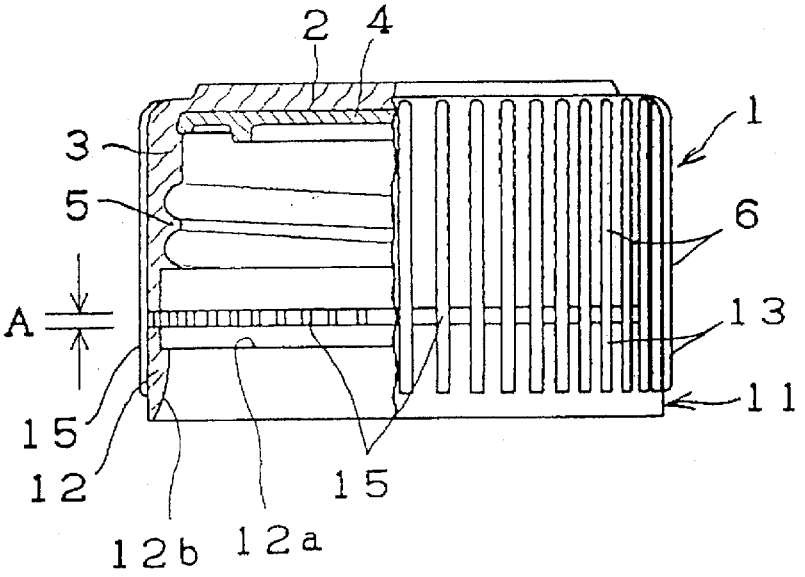
FIG. 1 is a partly cross-sectional front elevation of a screw cap embodying the invention.
Figure 2:
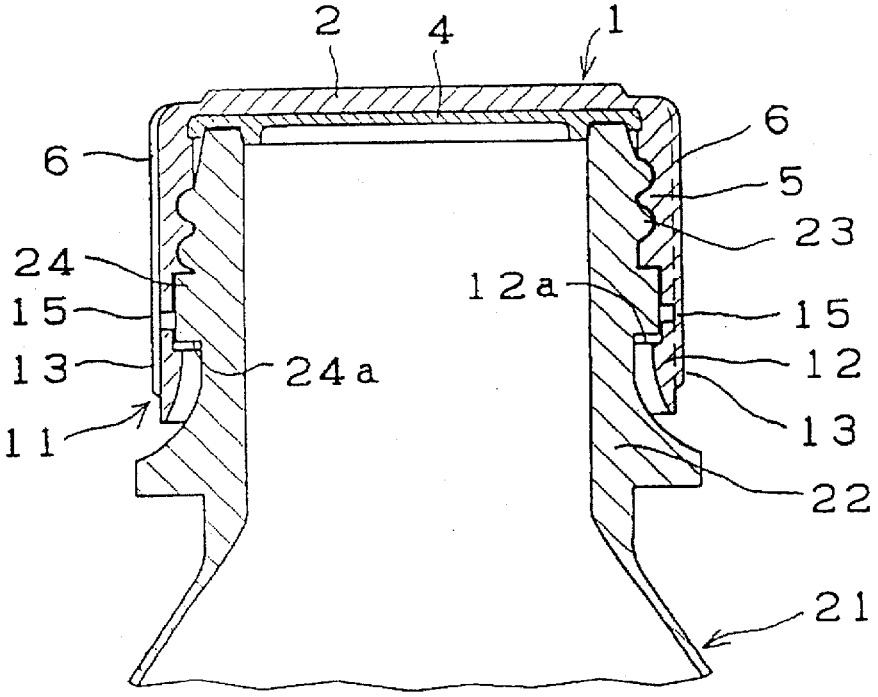
FIG. 2 is a longitudinal cross-sectional view of the screw cap applied onto a bottle neck.

An embodiment of the invention is described below with reference to the drawings. A cap generally comprises a main cap portion 1, connector strips 15, and a ring portion 11. The main cap portion 1 includes a top plate 2 and a cylindrical lateral wall 3. Attached to the inner surface of the top plate 2 is a packing member 4. The lateral wall 3 has formed female screw threads 5 along its inner surface and a number of longitudinal splines 6 along its outer surface. The female screw threads 5 are sized and designed to engage with male screw threads 23 formed on the outer surface of the neck 22 of a container 21 shown in FIG. 2. The splines 6 provide means for reliable transmission of external rotating force to the cap.

The ring portion 11 has the same diameter and thickness as those of the lateral wall. 3 of the main cap portion 1, and is coaxially aligned with the lateral wall 3 via a distance A from the open end thereof. The ring portion 11 has an annular inner projection 12 which projects radially inwardly over the entire circumference along the inner surface of the ring portion 11. The ring portion 11 also has formed a number of splines 13 on its outer surface. These splines 13 are continuous from the splines 6 on the main cap portion 1. The land 12*a* made by the inner projection 12*a* forms a plane for engagement with a downward-facing surface 24*a* of a ridge 24 made on the lateral outer surface of the neck 22 of the container 21. The inner end surface 12*b* of the projection 12 is slanted or arcuate in its cross section such that the ring portion 11 can readily ride across the container ridge 24 while resiliently increasing its inner diameter when the cap is thread-fitted onto the container aperture.

Both splines 6 and 13 are continuous and extend in the axial direction as mentioned above. Partial extensions of the splines lying over the distance A at the boundary between the splines 6 and 13 form the connector strips 15. That is, the ring 11 are held integral with the main cap portion 1 substantially only by the connector strips 15.

In operation, the cap is applied onto the aperture 22 of the container 21 which contain any desired product. When the main cap portion 1 is rotated in the capping direction, bringing the female screw 5 of the main cap portion 1 into thread engagement with the male screw 23 of the container 21, the main cap portion 1 moves deep onto the neck 22 of the container 21. The ring portion 11, held integral with the main cap portion 11 by the connector strips 15, also moves deep along the neck 22 while rotating together, and runs across the ridge 24 while resiliently increasing its inner diameter. When the main cap portion 1 gets in full thread engagement with the container 21, the ring portion 11 reaches beyond the ridge 24, with the land 12*a* of its projection 12 brought into engagement with the downward surface 24*a* of the ridge 24.

During the capping process, since the main cap portion 1 and the ring portion 11 rotate and move together in the same directions, the fragile connector strips 15 are not cut, and the entirety of the cap is held integral and continuous as it originally was.

When the cap is rotated in the opposite direction to uncap the container 21, the main cap portion 1 is moved in the withdrawal direction due to the thread engagement with the container 21. In this process, the ring portion 11 initially rotates together with the main cap portion 1; however, it cannot follow the axial movement of the main cap portion 1 due to engagement with the ridge 24 of the container 21. Therefore, the connector strips 15 are cut by opposite pulling forces from the main cap portion 1 and the ring portion 11. As a result, the screw cap is cut into two separate parts, the main cap portion 1 and the ring portion 11. Thereafter, even if the main cap portion 1 is once again screw-fitted onto the container aperture, it never becomes and appears integral with the ring portion 11.

The screw cap according to the invention can be fabricated by using a mold of a known type. For example, a mold disclosed in Japanese Patent Laid-Open 57-156231 (1982) or Japanese Patent Laid-Open 59-150715 (1984) or a mold proposed by the present inventor as disclosed in Japanese Patent Post-Examination Publication 5-55289 (1993) can be used, in which the part for making the undercut comprises some divisional slidable cores which are put on and slidably removed from the outer lateral surface of a head-cut conical core body such that the product can be removed from the mold by moving and reducing the diameter of the slidable cores.

In the above-described embodiment, all of the splines 6 and 13 extend over the area of the connector strips 15; however, some of them at desired intervals can be cut out in this area such that partial extensions of only a limited number of the splines are used as the connector strips 15, depending on the design desired.

As described above, according to the invention in which the splines formed on the main cap portion are extended onto the ring portion and used as the connector strips between the main cap portion and the ring portion, a totally uniform and continuous outer configuration of a screw cap can be obtained, in which also the ring portion appears as a continuous part of the main cap portion with a circumferential line of fine bores between the respective splines in the area of the connector strips.

This design of the screw cap with the main cap portion and the ring portion having a continuous, uniform appearance is particularly suitable for containers of cosmetics, beverages or seasonings which should desirably look high-graded or uncontaminated.

Although the invention has been shown and described with respect to preferred embodiments thereof, it should be understood by those skilled in the art that the foregoing and other changes and omissions in the form and detail thereof may be made therein without departing from the spirit and scope of the invention.

What is claimed is:

1. A screw cap comprising:

a main cap portion including a cylindrical lateral wall having an inner surface and an outer surface, said cylindrical lateral wall having screw threads formed on said inner surface;

a ring portion having an inner surface and an outer surface, said ring portion having a projection formed on said inner surface, said ring portion being spaced below said main cap portion; and a group of vertical splines, molded in one piece with the ring portion and the main cap portion, extending adjacent from an upper edge of the cylindrical lateral wall on said outer surface of said main cap portion downward adjacent to a lower edge on said outer surface of said ring portion thereby connecting said ring portion to said main cap portion, the portion of the vertical splines extending between the main cap portion and the ring portion being severable upon removal of the main cap portion.

2. The screw cap according to claim 1 wherein said ring portion has the same diameter and thickness as those of said cylindrical lateral wall.

3. The screw cap according to claim 1 wherein said projection extends over the entire circumference of said ring portion.

4. The screw cap according to claim 2 wherein said projection extends over the entire circumference of said ring portion.

5. The screw cap of claim 1 wherein:

the vertical splines each having substantially the same width and thickness.

6. The screw cap of claim 1 wherein:

said main cap portion and said ring portion having another group of vertical splines that extend along the outer surface of each of the main cap portion and the ring portion but do not connect the main cap portion with the ring portion.

7. The screw cap of claim 6 wherein:

there are more vertical splines in the group of vertical splines that connect the main cap portion with the ring portion than in the other group of vertical splines that do not connect the main cap portion with the ring portion.

* * * * *